US007297373B2

(12) United States Patent
Naik

(10) Patent No.: US 7,297,373 B2
(45) Date of Patent: Nov. 20, 2007

(54) CONDUCTIVE COMPOSITES

(75) Inventor: Vinesh Naik, DuPont, PA (US)

(73) Assignee: Noble Fiber Technologies, LLC, Scranton, PA (US)

( * ) Notice: Subject to any disclaimer, the term of this patent is extended or adjusted under 35 U.S.C. 154(b) by 0 days.

(21) Appl. No.: 11/282,792

(22) Filed: Nov. 18, 2005

(65) Prior Publication Data

US 2007/0116979 A1 May 24, 2007

(51) Int. Cl.
*B05D 1/18* (2006.01)
*C23C 22/60* (2006.01)
*C23C 28/02* (2006.01)

(52) U.S. Cl. ..... 427/438; 427/443.1; 205/271

(58) Field of Classification Search ..... 427/435, 427/436, 437, 438, 443.1, 430.1; 205/271
See application file for complete search history.

(56) References Cited

U.S. PATENT DOCUMENTS

| | | | | |
|---|---|---|---|---|
| 3,877,965 | A | | 4/1975 | Broadbent et al. |
| 4,061,802 | A | * | 12/1977 | Costello ..... 427/304 |
| 4,228,213 | A | | 10/1980 | Beckenbaugh et al. |
| 4,444,836 | A | | 4/1984 | Khattab |
| 4,535,032 | A | | 8/1985 | Sirinyan et al. |
| 4,657,786 | A | | 4/1987 | Sirinyan et al. |
| 4,814,205 | A | | 3/1989 | Arcilesi et al. |
| 5,389,496 | A | | 2/1995 | Calvert et al. |
| 5,397,599 | A | * | 3/1995 | Chao et al. ..... 427/306 |
| 5,419,829 | A | | 5/1995 | Fisher et al. |
| 6,045,680 | A | | 4/2000 | Cawston et al. |
| 6,468,593 | B1 | | 10/2002 | Iizawa et al. |
| 6,780,467 | B2 | | 8/2004 | Imori |
| 6,787,488 | B2 | | 9/2004 | Takagi et al. |
| 6,902,765 | B2 | | 6/2005 | Brandes et al. |
| 6,924,244 | B2 | | 8/2005 | Takagi et al. |
| 2004/0173056 | A1 | | 9/2004 | McNally et al. |

FOREIGN PATENT DOCUMENTS

| | | | |
|---|---|---|---|
| CN | 1558017 | | 12/2004 |
| CN | 1587494 | | 3/2005 |
| JP | 2000014615 | | 1/2000 |
| JP | 2003-236982 | * | 8/2003 |

OTHER PUBLICATIONS

Fisher, Bryan "Avoid nickel plating losses", 2005, PF Online, (http://www.pfonline.com/articles/090503.html), 5 pages, no month.

Graves, Beverly A., "Nickel Plating Primer", 2005, PF Online, (http://www.pfonline.com/articles/040102.html), 4 pages, no month.

Environmental Protection Agency, Clean Processes, Metals Recovery "Electroless Nickel Bath Life Extension", 2005, (http://www.epa.gov/cgi-bin/epaprintonly.cgi), 3 pages, no month.

Graham, G. et al. "Environmental Metal Plating Alternatives—Electroless Nickel Plating Rejuvenation (Task N.089)", NDCEE, Ref. 05-4; p. 71, no date.

"The Electroless Nickel process", SEC Surface Engineering Consulting UK; (http://www.secfinishes.co.uk/electolessnickel.htm), 2005, 1 page, no month.

House, J.R. "Electroless Nickel for design engineers", SEC Surface Engineering Consulting UK (http://www.secfinishes.co.uk/articles/electoles_nickel.htm), 2005, 4 pages, no month.

* cited by examiner

*Primary Examiner*—Michael E. Lavilla
(74) *Attorney, Agent, or Firm*—Akerman Senterfitt; Joseph W. Bain; Michael K. Dixon

(57) ABSTRACT

A conductive composite material formed from an organic polymer base, a highly conductive metal interlayer, and an electroless nickel top layer is described. The composite material may be electrically conductive and resistant to corrosion. The highly conductive metal interlayer may be silver or copper. An electroless nickel plating process is described that efficiently deposits the nickel top layer without the use of, surfactants, and stabilizers at low temperatures. The method enables reduction of substantially all of a nickel salt onto the silver surface leaving a spent bath solution free of nickel that can be recycled.

9 Claims, 2 Drawing Sheets

CONDUCTIVE COMPOSITES

FIELD OF INVENTION

The invention relates to conductive composites, and more particularly to flexible conductive composites.

BACKGROUND OF THE INVENTION

The need for electrically conductive organic polymeric structures has increased. One method to achieve such structures is the formation of a composite between the organic polymer and a metal. Flexible conductors of this type are useful for electromagnetic wave shielding materials and other applications. The reduction in size of electronic devices requires greater flexibility, durability and softness for conducting materials, and such reduction is most easily achieved by the use of a fabric from a metal-coated organic polymer fiber. The manner in which the conducting fibers have been prepared has varied depending upon the desired metals that have been placed on the organic polymer. Silver and copper are the two primary metals deposited on organic polymers for these applications because these metals have very high conductivities. Unfortunately, these two metals easily undergo corrosion and are inherently soft, lacking the durability required for many applications.

The deposition of silver on organic polymers is well known. This is described in United States Patent Application Publication 2004/0173056. Likewise, the deposition of copper on organic polymers is well known and is described in U.S. Pat. No. 4,228,213.

Nickel is frequently deposited on a metal to enhance the surface properties of the metal. Usually this is carried out by an electroless plating process. Although an electrodeposition process can produce a nickel-plated structure, it requires a conductive substrate and gives a different coating than an electroless plated structure. The electroless plated structure typically displays less pure nickel but the coating is typically thicker and more even. The electroless plated nickel is generally superior in corrosion resistance.

The electroless plating process is often carried out by the addition of a reducing agent to a solution containing a metal salt. For the deposition of nickel, common reducing agents include sodium hypophosphite, sodium borohydride, dimethylamine borane, and hydrazine. Depending upon the reducing agent that is used, the metal displays some content of phosphorous, boron, or nitrogen. The nickel deposits are generally characterized as high phosphorous, low phosphorous, high boron, and so forth. When sodium hypophosphite is used as the reducing agent, phosphorous can range from about one percent to about 15 percent of the nickel coating. The properties of the coating depend upon the amount of the non-nickel content. Properties that can vary include conductive, magnetic and corrosion resistance properties.

The most commonly used reducing agent for electroless nickel deposition is sodium hypophosphite. The process can be described by the following equation:

$$Ni^{+2}+H_2PO_2^-+H_2O \rightarrow Ni^0+H_2PO_3^-+2H^+$$

This reaction competes with the following reaction:

$$H_2PO_2^-+H_2O \rightarrow H_2PO_3^-+H_2\uparrow$$

Both of these reactions involve the adsorption of atomic hydrogen on a catalytically active surface. The adsorbed hydrogen either combines to form hydrogen gas or transfers an electron to reduce the nickel ion to nickel metal. The adsorbed hydrogen is believed to be responsible for the reduction of hypophosphite to phosphorous, and the phosphorous is incorporated into the nickel coating.

The electroless deposition technique requires the formation of the catalytically active surface prior to the autocatalytic reduction of nickel (II) to nickel metal on the surface. The nature of the catalyst added to generate the catalytically active substrate surface is dependent on the substrate, and for noble metals and non-metals, the common catalyst is a palladium species. A particularly effective system uses stannous chloride and palladium chloride to form the catalytically active surface. Typically, a colloid is formed from a reaction of palladium chloride and stannous chloride in the presence of excess hydrochloric acid to treat the surface for electroless plating of nickel.

In addition to the catalyst to form the active surface, a typical deposition bath requires a complexing agent, a pH regulator, an accelerator, a stabilizer, a buffer, a wetting agent and a reducing agent to achieve a desired metal coating. This complex mixture unfortunately results in a waste stream that is complicated to process. A typical electroless nickel bath is spent after three or four turnovers at which time it is considered waste. This spent bath typically contains nickel at a concentration of more than 5,000 mg per liter, unreacted reducing agent, oxidized reducing agent, and all of the other components previously mentioned. The spent bath is usually treated with hydrated lime to precipitate nickel salts and the remainder of the sludge, which still has significant quantities of nickel, is frequently sent to a landfill with potential environmental risks and, in the United States, an economic risk to the generator of the waste stream.

Numerous studies directed toward the reduction and treatment of waste from electroless nickel plating processes have been carried out and are in progress. The direction of these studies include alternate plating chemistries, plate out of residual nickel, ion exchange and electrodialysis.

A need for a corrosion resistant highly conductive metal-coated plastic substrate remains. More specifically, a need exists for a composite including the flexibility and strength of a polymeric substrate and a highly conductive metal that is resistant to corrosion. Furthermore, a need exists for an electroless nickel process that permits many turnovers of a bath and leaves little or no nickel in the spent bath, thereby reducing expenses associated with environmental cleanup.

SUMMARY OF THE INVENTION

This invention is direct to a conductive composite that may be formed from a polymer base, a metallic interlayer, and a metallic top layer. In at least one embodiment, the conductive composite may be formed from an organic polymer base, a highly conductive metal interlayer, and a nickel top layer. The organic polymer can be any suitable organic polymer including polyamide, polyimide, polyester, polyurea, polyurethane, polyolefin, polyacrylate, polycarbonates, polyethers, vinyl polymers, other organic polymer or copolymers thereof. The metal interlayer can be silver, copper, or other appropriate material. The interlayer may be between about 10 percent and about 30 percent of the weight of the composite. The nickel top layer can be between about five percent and about 20 percent of the weight of the composite. The nickel top layer may contain phosphorous at less than 10 percent by weight of the top layer. In particular, the nickel top layer may contain phosphorous between about one percent and about 10 percent by weight of the top layer.

The invention also includes a method for preparing a conductive composite with a polymer base, a highly conductive metal interlayer and a nickel top layer. A polymer base coated with a highly conductive metal such as silver or copper is cleaned and brought in contact with an aqueous solution of a tin salt. The tin salt may be, but is not limited to being, stannous chloride or other appropriate materials. The polymer base coated with a highly conductive metal is then washed to remove excess tin salt and brought into contact with an aqueous solution of a palladium salt. The palladium salt may be, but is not limited to being, palladium (II) chloride or other appropriate materials. After washing excess palladium salt for the polymer base coated with a highly conductive metal it is contacted with an aqueous solution comprising nickel sulfate, sodium hypophosphate, ammonium sulfate and ammonia at a low temperature. The weight ratio of nickel sulfate to sodium hypophosphite is between about 0.6 and about 0.9 in the nickel plating solution. The nickel plating is carried out at a pH between about 8.5 and about 10.0 and at a temperature between about 35° C. and about 90° C.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
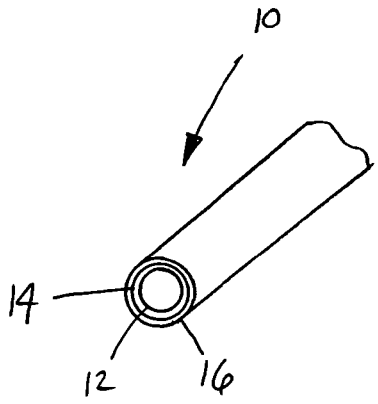
FIG. 1 is a perspective view of an embodiment of the invention.
Figure 2:
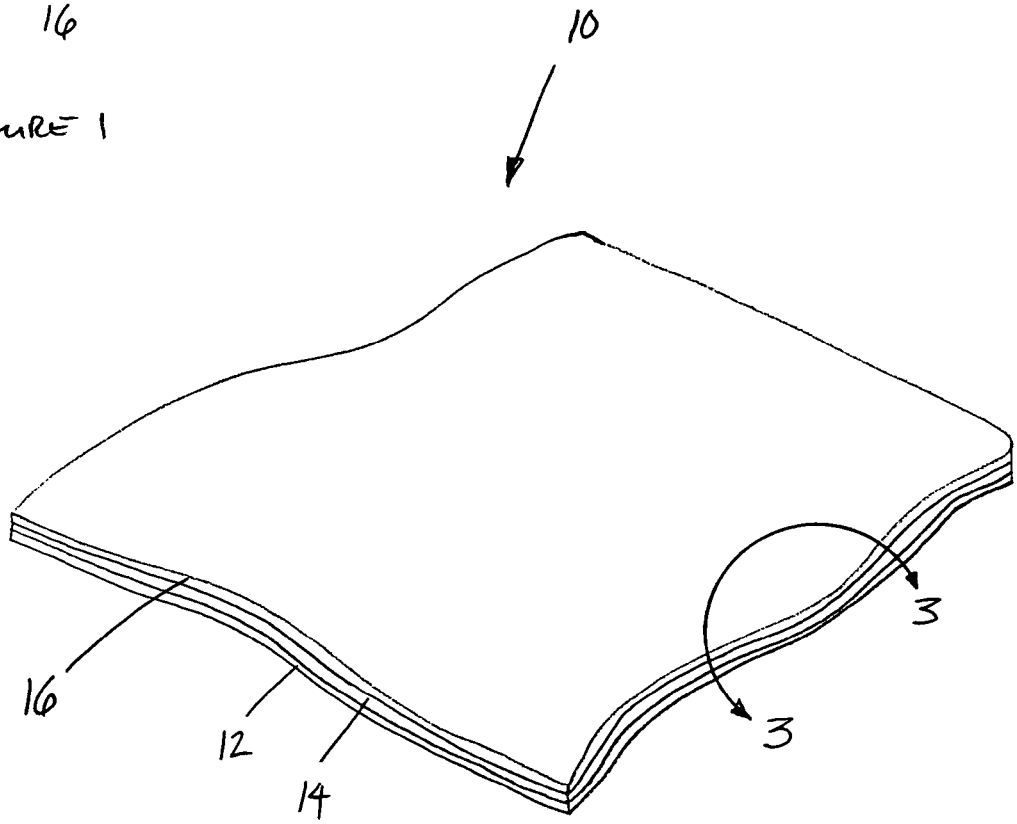
FIG. 2 is a perspective view of an alternative embodiment of the invention.
Figure 3:
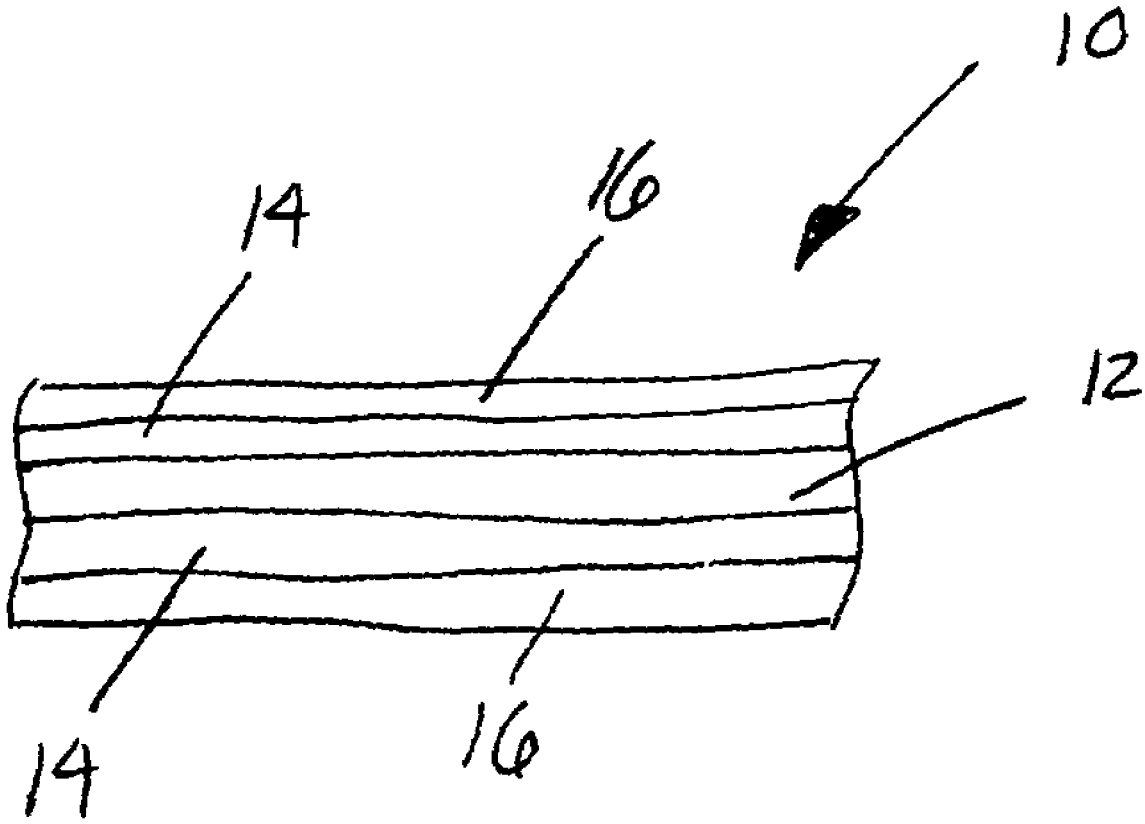
FIG. 3 is a detail view taken in FIG. 2 of yet another alternative embodiment of the invention.

This invention, as shown in FIGS. 1-3, is directed to a conductive composite 10 and a method of forming the conductive composite 10. In at least one embodiment, the conductive composite 10 may be formed by a polymer 12 coated with a metallic interlayer 14. The metallic interlayer 14 may in turn be coated with a metallic top layer 16. The interlayer 14 coated on the polymer 12 may be, but is not limited to being, silver, copper, or other appropriate material. The top layer 16 coated on the interlayer 14 may be, but is not limited to being, nickel or other appropriate material.

The process of forming a metallic coated polymer 12 may be prepared for a silver or copper coating on an organic polymer substrate 12 using processes that are commercially available or easily prepared by known methods. A silver coated onto as organic polymer substrate 12 such as nylon may be prepared as described in United States Patent Application Publication No. US 2004/0173056 and in U.S. Pat. No. 3,877,965. The formation of a copper coated organic polymer substrate 12 such as nylon may be prepared as described in U.S. Pat. No. 4,228,213. The polymer 12 may be a polyamide, polyimide, polyester, polyurea, polyurethane, polyolefin, polyacrylate, polycarbonates, polyethers, vinyl polymers, other organic polymer or copolymers thereof, whereby the copolymer may be alternating, random, block, or branched. The polymer 12 may also be cross-linked.

The polymer 12 may be in the form of a fiber or a yarn, as shown in FIG. 1, a fabric, a film, a sheet, molded structure or machined structure, as shown in FIGS. 2 and 3. The conductive composite 10 may be coated over an entire surface, on a single surface, or positioned on a portion of a surface. As shown in FIG. 1, the interlayer 14 may coat entirely the polymer 12, and the top layer 16 may coat entirely the interlayer 14. As shown in FIG. 2, the polymer 12 may be coated on one side with an interlayer 14 and a top layer 16. As shown in FIG. 3, the polymer may be coated on two sides by an interlayer 14 and a top layer 16.

The process of coating the substrate 12 involves cleaning the substrate 12, activating the substrate 12 for deposition of a conductive metal, and then performing an electroless plating process by the action of a reducing agent on a soluble salt of the metal. The nature of the cleaning method can vary depending upon the nature and even more specifically on the source of a given organic polymer 12. The cleaning method may include rinsing with water or may include a complicated removal of a film or etching of a surface using organic solvents, acids, oxidizing agents, et cetera.

Activation of the substrate 12 typically involves placing the washed substrate 12 into a solution containing a tin salt. The activated substrate 12 is then exposed to a solution containing a silver salt and a reducing agent. The solution typically contains complexing agents and often includes surfactants, stabilizers, and other chemicals to aid in the deposition of the silver. Formulations for the electroless deposition of silver onto a polymer 12 are commercially available and specific methods are well described in the art. As the final composite structure 10 formed from a top layer 16 on an interlayer 14 on a polymer 12 is designed to have between about 10 percent and about 30 percent by weight silver, the silver coated substrate 12 and 14 can have a weight percent of silver between about 12.5 percent and about 37.5 percent.

As previously stated, the metallic coating on the polymer 12 may be, but is not limited to being, copper. The deposition of copper on an organic polymer substrate 12 involves similar steps to that of depositing silver where the substrate 12 is washed, activated and then exposed to a solution containing a copper salt and a reducing agent. The nature of the washing step can vary depending on the substrate 12. The activation may be carried out by exposure to a solution containing a tin salt and a noble metal which may be palladium, platinum, silver, or gold. The copper may then be deposited on the activated surface from a solution that contains a copper salt and a reducing agent along with a variety of complexing agents, stabilizers etc. Formulations for the electroless deposition of copper are commercially available and specific methods are well described in the art. As the final composite structure 10 formed from a top layer 16 on an interlayer 14 on a polymer 12 is designed to have between about 10 percent and about 30 percent by weight copper, the copper coated substrate 12 and 14 can have a weight percent of copper between about 12.5 percent and about 37.5 percent.

A method of depositing nickel on a highly conductive metal surface is herein described for the deposition of nickel onto silver. A description of the deposition of nickel onto copper is not described because the method is substantially identical to the deposition of nickel onto silver. A top layer 14 formed from nickel may be applied to the silver coated polymeric structure 12 by the following electroless nickel plating method. The electrodeposition of nickel in an electrolysis process may be used, but such as process creates a nickel coating that is not sufficiently resistant to corrosion.

The silver surface 14 is first cleaned by immersion in a dilute tetrasodium pyrophosphate solution and then washing with deionized water. This can be carried out by placing the cleaned portion of the metal coated polymer 12 in a bath where the deionized water is passed through the bath.

The substrate 12 with the cleaned silver surface 14 may then transferred to a bath containing a tin salt solution, which may be for example, stannous chloride, directly from the bath where it was rinsed. The silver surface 14 may again washed with deionized water and subsequently immersed into a bath containing a palladium salt, which may be for example palladium chloride. The exposure to air between the rinsing and the introduction to the palladium salt bath should be minimal and that the silver coated substrate 12 and 14 is maintained in the rinsing bath until the palladium chloride bath is ready for acceptance of the silver coated substrate 12 and 14. After the exposure to the palladium salt solution the surface is again rinsed in a bath. The exposure to air should be again avoided after washing the palladium activated silver coated substrate 12 and 14. It is most convenient to maintain the substrate 12 in the rinsing bath until the subsequent step is to be performed.

The silver coated substrate 12 and 14 may then be immersed in an electroless nickel plating solution. The electroless nickel plating solution may consist of nickel sulfate and sodium hypophosphite in a basic ammonium sulfate solution. The basic ammonium sulfate can be prepared by mixing sulfuric acid with ammonia solution using more than two equivalents of ammonia to sulfuric acid. The molar ratio of sulfate ion to nickel ion in the initial solution may be between about 2.8 to 1 and about 3.4 to 1. A sufficient concentrated ammonia results in a pH between about 9.5 and about 10. The molar ratio of nickel sulfate to sodium hypophosphite may be between about 0.6 and about 0.9. The weight of nickel that may be deposited is controlled by the weight of nickel salt to silver coated substrate 12 used. The amounts may be determined because substantially all of the nickel ion is converted into nickel metal on the metal coated polymer 12, and the amount of nickel that will be deposited can be predicted.

The ratio of nickel ion to hypophosphite ion in the present invention may be significantly greater than a conventional ratio in standard electroless nickel baths, in which a molar ratio of about 0.4 is typically used to assure sufficient reducing agent. The lower ratio of nickel salt to hypophosphite is used to assure sufficient reducing agent to convert nickel ion to nickel metal. The use of a higher molar ratio results in less effective competition of water and hypophosphite with hypophosphite to form hydrogen and phosphorous, respectively. At typical ratios of nickel salt to hypophosphite, stabilizers are required.

The initial range of pH should be equal to or greater than about 8.5 and is most effective at pH values between about 9 and about 10. Solutions that are more basic are detrimental to the bath and result in the precipitation of nickel salts. This pH range is easily maintained and adjusted by the addition of an ammonia solution.

Concentrated ammonium hydroxide solution can be added as necessary to adjust the pH but the initial solution can be formulated such that all of the nickel can be deposited on the silver without the addition of more ammonia. As the reaction progresses the pH drops and ultimately stabilizes at about 8.5. The blue-green color of the solution disappears completely indicating the reduction of the $Ni^{+2}$ to $Ni^{0}$ which plates out only on the catalytically active surface.

The temperature should be kept above about 35° C. but need not exceed about 50° C. to achieve a reasonable deposition rate with little difference in the rate of deposition observed over this small temperature range. The rate of deposition increases with temperature. Temperatures as high as 90° C. and greater can be used but are not required for reasonable deposition rates. Complete deposition of the nickel can be achieved when the silver coated structure is immersed for less than one hour. Formulations may also be created in which deposition of nickel occurs in periods of less than ten minutes are possible.

No stabilizer, accelerator, buffer, nor complexing agent, in addition to ammonia, need be included. This appears to result from the higher molar ratio of nickel ion to hypophosphate ion and the pH range that is used. The incorporation of additives can be detrimental to the deposition process. For example, the inclusion of the common stabilizer, tartaric acid, reduces the rate of deposition relative to the system free of this stabilizer. The addition of these additives complicates the waste disposal process and increases the cost of the process. Conversely, the absence of these additives coupled with the absence of nickel salts in the spent electroless bath simplifies the waste disposal. The spent bath requires only neutralization of the base to permit disposal under common environmental requirements. The electroless nickel bath can be recycled by the addition of nickel salt and hypophosphite salt.

The electroless nickel deposition method of the present invention is illustrated by the following non-limiting examples.

EXAMPLE 1

A 2 L bath was charged with 700 mL of deionized water and warmed to 40° C. on a hot plate. A solution was prepared by the addition of 3.086 g of nickel sulfate, 4.40 mL of 50 volume percent sulfuric acid solution, and 6.60 mL of 29% ammonium hydroxide solution to 100 mL of deionized water. A second solution was prepared by the addition of 1.984 g of sodium hypophosphite to 100 mL of deionized water. The pH of the bath was 9.5 and the solution was blue in color. The bath was maintained between about 35° C. and about 45° C. A 6.627 g sample of silver coated nylon yarn was added to the bath. The silver coated nylon yarn was a 100 denier nylon yarn with 34 filaments per strand coated such that the mass of silver was twenty percent of the mass of the coated yarn. After submersion of the yarn, the solution faded in color and was colorless in less than one hour. Analysis of the solution displayed no nickel, 0 ppm, by atomic absorption spectrophotometry. The resulting fiber was 72% nylon, 15% silver and 13% nickel.

EXAMPLE 2

A 2 L bath was charged with 700 mL of deionized water and warmed to 40° C. on a hot plate. A solution was prepared by the addition of 4.657 g of nickel sulfate, 6.64 mL of 50 volume percent sulfuric acid solution, and 9.96 mL of 29% ammonium hydroxide solution to 100 mL of deionized water. A second solution was prepared by the addition of 2.994 g of sodium hypophosphite to 100 mL of deionized water. The pH of the bath was 9.5 and the solution was blue in color. The bath was maintained between about 35° C. and about 45° C. A 10.0 g sample of silver coated nylon with 10% SPANDEX fabric was added to the bath. The mass of silver was twenty percent of the mass of the fabric. After submersion of the fabric, the solution faded in color and was colorless in less than one hour. Analysis of the solution displayed no nickel, 0 ppm, by atomic absorption spectrophotometry. The resulting fabric had 15% silver and 13% nickel by weight of the resulting fabric.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A method for preparing a conductive composite by forming a nickel phosphorus alloy electrolessly, comprising:

providing a metallic coated polymer base;

cleaning the metallic coated polymer base;

contacting the metallic coated polymer base with an aqueous solution of a tin salt;

washing the metallic coated polymer base after exposure to the aqueous solution of a tin salt to remove excess tin salt;

contacting the metallic coated polymer base with an aqueous solution of a palladium salt;

washing the metallic coated polymer base after exposure to the aqueous solution of a palladium salt to yield a palladium activated metallic coated polymer base; and contacting the metallic coated polymer base with an aqueous solution comprising nickel sulfate, sodium hypophosphite, ammonium sulfate and ammonia.

2. The method of claim 1, wherein a metal forming the metallic coated polymer base is silver.

3. The method of claim 1, wherein a metal forming the metallic coated polymer base is copper.

4. The method of claim 1, wherein a metal forming the metallic coated polymer base is between about 12.5 percent and about 37.5 percent by weight of the metallic coated polymer base.

5. The method of claim 1, wherein the tin salt is stannous chloride.

6. The method of claim 1, wherein the palladium salt is palladium (II) chloride.

7. The method of claim 1, wherein a weight ratio of nickel sulfate to sodium hypophosphite is between about 0.6 and about 0.9.

8. The method of claim 1, wherein a pH of the aqueous solution comprising nickel sulfate, sodium hypophosphite, animonium sulfate and ammonia is between about 8.5 and about 10.0.

9. The method of claim 1, wherein a temperature of the aqueous solution comprising nickel sulfate, sodium hypophosphite, animonium sulfate and ammonia is between about 35° C. and about 90° C.

* * * * *